US005494372A

United States Patent [19]

Oliver et al.

[11] Patent Number: 5,494,372

[45] Date of Patent: Feb. 27, 1996

[54] PAVEMENT IMPRINTING APPARATUS AND METHOD

[75] Inventors: Gerry B. Oliver; Bruce L. Burton, both of Kelowna, Canada

[73] Assignee: IPC Technologies Inc., White Rock, Canada

[21] Appl. No.: 237,153

[22] Filed: May 3, 1994

[51] Int. Cl.[6] ..... E01C 23/00

[52] U.S. Cl. ..... 404/72; 404/89

[58] Field of Search ..... 404/72, 73, 17, 404/34, 47, 87, 42, 89, 93; 427/271, 272, 282

[56] References Cited

U.S. PATENT DOCUMENTS

| | | | |
|---|---|---|---|
| 278,238 | 5/1883 | Harding . | |
| 333,459 | 12/1885 | Gibson . | |
| 2,056,254 | 10/1933 | Holdsworth | 91/16 |
| 2,365,705 | 12/1944 | Jeri | 117/6 |
| 3,096,195 | 4/1960 | Seman | 117/8.5 |
| 3,182,109 | 5/1965 | Greulich | 404/72 X |
| 3,692,458 | 9/1972 | Kirsch | 425/469 |
| 3,832,079 | 8/1974 | Moorhead | 404/89 X |
| 4,105,354 | 8/1978 | Bowman | 404/72 |
| 4,131,406 | 12/1978 | Fresquez | 425/385 |
| 4,239,820 | 12/1980 | Salvador | 427/272 |
| 4,379,187 | 4/1983 | Seman | 427/282 |
| 4,510,729 | 4/1985 | Syring | 52/741 |
| 4,828,426 | 5/1989 | Hendricks et al. | 404/89 X |
| 5,038,714 | 8/1991 | Dye et al. | 118/504 |
| 5,173,337 | 12/1992 | Nelson | 427/282 |
| 5,186,983 | 2/1993 | Brown | 427/261 |
| 5,215,402 | 6/1993 | Stowell et al. | 404/93 |
| 5,263,294 | 11/1993 | Koenig et al. | 52/468 |

FOREIGN PATENT DOCUMENTS

| | | | |
|---|---|---|---|
| 0160315 | 11/1985 | European Pat. Off. . | |
| 0589673 | 3/1994 | European Pat. Off. . | |
| 348230 | 5/1931 | United Kingdom | 427/282 |
| 896135 | 5/1962 | United Kingdom | 427/282 |

*Primary Examiner*—Michael Powell Buiz
*Attorney, Agent, or Firm*—Oyen Wiggs Green & Mutala

[57] ABSTRACT

A grid for producing a pattern on a surface. The grid includes elongated members connected together at intersections and extending about a plurality of open areas to form a mesh-like structure. Connecting members are connected to the elongated members at the intersections. The connecting members extend outwardly from at least one said elongated member. The connecting members have a thickness less than the thickness of the elongated members. The bottoms of the connecting members and bottoms of the elongated members are flush. The grid is placed on a surface and a liquid coating is spread over the surface in the open areas between the elongated members. The liquid coating is allowed to set. Preferably there is a removable coating on the grid which is removed after the liquid coating is set.

32 Claims, 3 Drawing Sheets

PAVEMENT IMPRINTING APPARATUS AND METHOD

BACKGROUND OF THE INVENTION

This invention relates to an apparatus and method for imprinting a surface with a design similar to bricks or stones and mortar.

Various apparatuses and methods have been devised to simulate the appearance of bricks and mortar or stones and mortar on horizontal or vertical surfaces such as driveways, floors or walls. Typically a paint or concrete mixture is applied in a thin coat on the surface with contrasting colors used for the bricks or stones and the mortar. The method commonly used is to apply a coating having the desired color of the mortar on the surface. Masking tape is then placed over this coating in a grid-like pattern to simulate the mortar. A second coating is then applied over the surface in the desired color of brick or stone. Finally the masking tape is removed, leaving lines of "mortar" between the "bricks" or "stones". However this method is labor intensive because of the considerable amount of work in laying out the pattern of masking tape and the requirement to apply two separate coatings to the surface.

Various products and methods have been developed in the past to simulate the appearance of brick or stone on other surfaces. One example is U.S. Pat. No. 4,379,187 to Seman. This discloses a method of simulating mortar lines on a brick wall using a preformed, grid-like structure. The grid is removed after the brick-like material is applied.

U.S. Pat. No. 4,239,820 discloses a method of creating a simulated stone surface of the like. A pattern is partially die cut and has an adhesive on one side. U.S. Pat. No. 5,186,983 to Brown shows a process for decorating a hard surface. A template with holes is used. However, the "mortar" is first applied by means of colored paint.

The art described above has one thing in common. All of the art relies on removing a peelable layer along the lines of "mortar" to expose a layer having a distinct color and appearance compared to the "brick". This generally requires the application of two separate coatings to the surface thus increasing the mount of work and time involved. Furthermore, the appearance of the "mortar" is not always true to life because the effect is limited to the preexisting surface or coating exposed when a peelable layer is removed.

SUMMARY OF THE INVENTION

It is therefore an object of the invention to provide an improved apparatus and method for producing a brick and mortar or stone and mortar appearance on a surface which is less labor intensive and time consuming compared to prior art methods and apparatuses.

It is also an object of the invention to provide an improved apparatus and method of this type which requires the application of only a single liquid coating to the surface.

It is a further object of the invention to provide an improved apparatus and method of this type which provides a more convincing brick and mortar or stone and mortar appearance on the surface.

It is still a further object of the invention to provide an improved apparatus and method of this type which produces a simulated brick and mortar or stone and mortar surface which is durable and long lasting.

In accordance with these objects, there is provided a grid for producing a pattern on a surface. The grid includes elongated members connected together at intersections and extending about a plurality of open areas to form a mesh-like structure. Each elongated member has a top, a bottom and a thickness extending between the top and the bottom. There are connecting members which are connected to the elongated members at the intersections. Each of the connecting members extends outwardly from at least one elongated member. Each connecting member has a top, a bottom and a thickness less than the thickness of said one elongated member. The bottoms of the connecting members and the elongated members are flush with each other.

According to another aspect of the invention, there is provided a method of producing a grid-like pattern on a surface. The method includes placing on the surface a grid which includes a plurality of elongated members connected together at intersections and extending about a plurality of open areas. The grid has a top with a removable solid coating thereon. A liquid coating is spread over the surface in the open areas between the elongated members of the grid. The liquid coating is allowed to set. The solid coating is then removed from the grid, exposing the elongated members.

Compared to prior art apparatuses and methods, the invention provides significant advantages. The appearance of mortar is achieved by applying a grid which is left in place instead of being removed as in the prior art. Thus the surface of the mortar can have a more convincing shape and texture than can be achieved simply by exposing the preexisting surface or an earlier applied liquid coating. Furthermore, the time to do the job can be appreciably reduced since only a single liquid coating is necessary.

DESCRIPTION OF THE PREFERRED EMBODIMENTS

Figure 1:
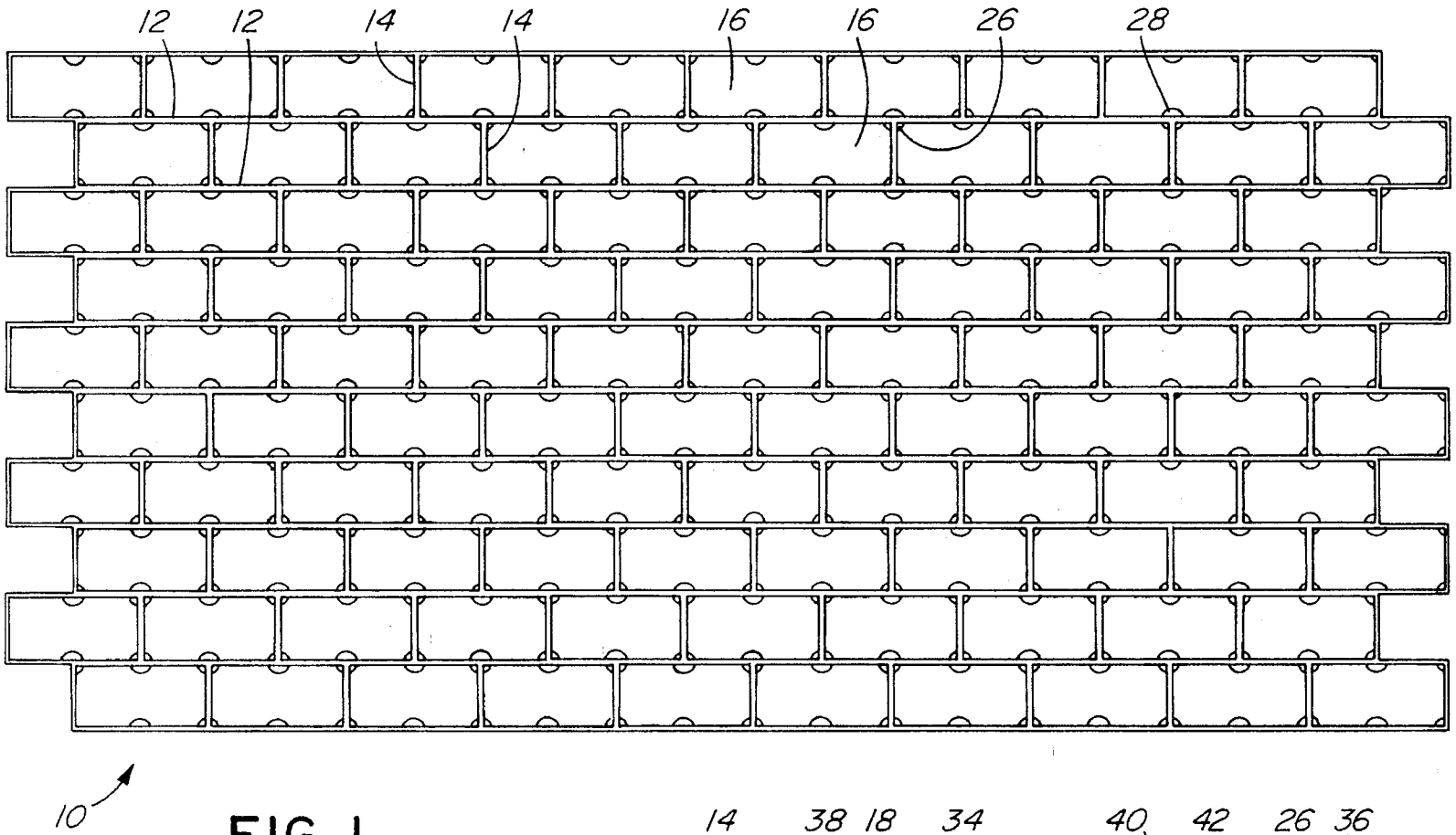
FIG. 1 is a top plan of a grid for producing a pattern on a surface according to an embodiment of the invention.

FIG. 1 shows a grid 10 for producing a pattern on a surface. The grid includes a plurality of first elongated members 12 which extend in parallel relationship along the length of the grid. The first members 12 are interconnected by a plurality of second members 14 which are parallel to each other and extend perpendicularly between adjacent members 12. The members 14 are staggered so that open areas 16 between the members 12 and 14 are rectangular and form a brick-like pattern with the members 12 and 14 mimicking lines of mortar between. It should be understood however that other patterns of brick, stone or the like could be simulated by the grid as well by using other configurations of elongated members including curved elongated members instead of the straight members illustrated in FIG. 1. The elongated members form a mesh-like structure with the open areas 16 therebetween.

Figure 4:
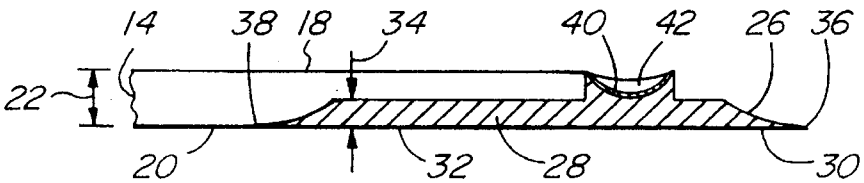
FIG. 4 is a sectional view taken along line 4—4 of FIG. 2.
Figure 2:
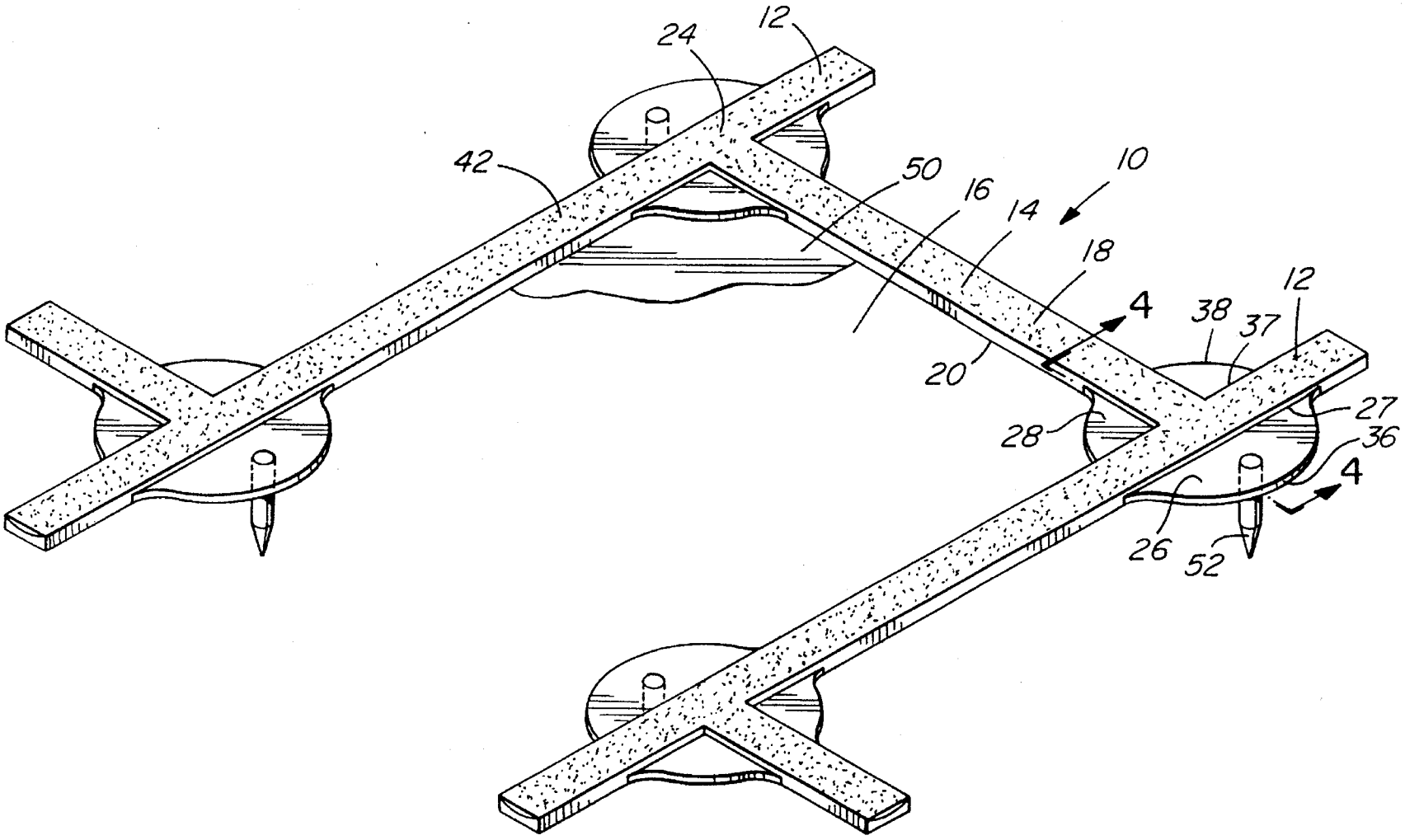
FIG. 2 is an enlarged, fragmentary isometric view thereof.

With reference to FIG. 2 and 4, each of the elongated members 12 and 14 has a top 18, a bottom 20 and a thickness 22 extending therebetween as seen in FIG. 4. The elongated members 12 and 14 are connected together by a plurality of intersections 24. There is a plurality of connecting members 26 and 28 at each intersection 24. The connecting members 26 are semi-circular while the members 28 are quarter-circular. However they may be other shapes as well.

Two members 28 and one member 26 form a disc-like flange at each complete intersection. Inner edges 27 and 37 of the members 26 and 28 are connected to at least one elongated member while edges 36 and 38 are convexly curved. The members 26 and 28 have bottoms 30 and 32 respectively which are flush with the bottoms 20 of the members 12 and 14 as seen in FIG. 4. However, the connecting members 26 and 28 have a thickness 34 substantially less than the thickness 22 of the members 12 and 14. In this preferred embodiment the thickness 34 of the connecting members 26 and 28 is one half the thickness 22 of the elongated members 12 and 14.

In this preferred embodiment the outer edges 36 and 38 of the connecting members are tapered as seen in FIG. 4, which helps to hide the outer edges of the connecting members when the grid is used as described. The preferred material for the grid is concrete with a additive. This provides compatibility with the liquid coating applied in the areas 16 as described below. The coating applied in areas 16 and the grid therefore have similar properties such as thermal expansion to ensure a durable long life for the finished surface. The grid can be made from a mixture of silica sand, cement powder and polymer with added fibres and/or carbon chucks for improved wear.

As seen in FIG. 4, each of the elongated member 12 and 14 has a transversely concave top 40 which initially is covered by a removable coating 42. This coating could be of various materials including peel-off tape. However, wax is used in this preferred embodiment. Candle wax, bees wax on other waxes may be used. The wax coating may be formed first in a mold having a concave bottom and a grid-like shape. The wax grid is then removed, inverted and placed in a second grid shaped mold having a flat bottom. The polymer enhanced concrete, or other material forming the permanent portion of grid 10, is poured on top of the wax. The elongated members is this example are 0.48 to 0.64 cm. thick. However, this is not critical.

METHOD

In use, the grid 10 is applied over a surface 50 where a brick-like or stone-like pattern is desired. The grid could be secured to the surface by an adhesive, such as some of the prior art grids, but no such adhesive is used in this example. This allows the grid to be moved about and positioned adjacent other similar such grids to achieve the desired effect. Once the grid is in the proper place, it is secured by fasteners 52 shown in FIG. 2. Various types of fasteners could be used, such as screws, nails or staples, but in this example lead or plastic plugs are preferred.

A concrete drill is used to drill through the connecting members 26 or 28 and into the surface to a depth of approximately 1 cm. The lead or plastic plugs are then insert through the connecting members and hammered into place there. It should be noted that these plugs are only required on low spots or dips in the surface. They hold the grid against the surface despite irregularities therein. If the surface is perfectly flat and generally horizontal then the grid may be held in place only by the liquid coating as described below. On the other hand an adhesive or fasteners are essential when a vertical surface, such as a wall, is to be coated.

Alternatively, the existing surface may first be prepped with a thin layer, about 1.5 mm, of the polymer concrete before applying the grid. This may be applied with a squeegee, doing a small portion at a time. The grid is applied while the coating is still damp, thus avoiding voids or air pockets under the grid. The coating acts as an adhesive so fasteners are not required. The remaining liquid coating is applied immediately after the grid is positioned. The coating goes over the connecting members and dries there permanently, thus further securing the grid in place.

Figure 3:
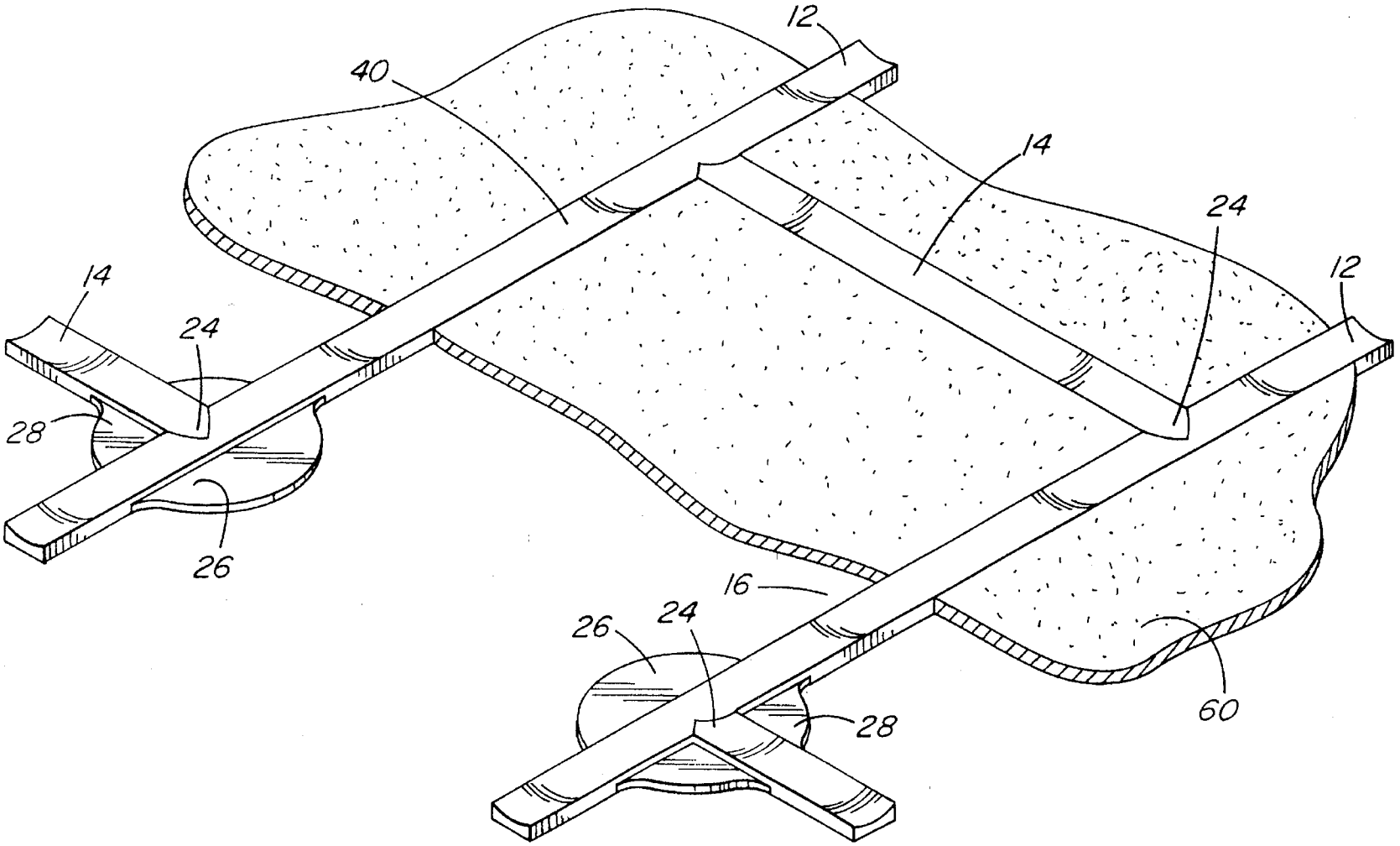
FIG. 3 is a view similar to FIG. 2 showing a grid after a liquid coating has been applied therebetween.

Once the grid is in place a liquid coating 60, as shown in FIG. 3 is applied to the areas 16 between the elongated members 12 and 14. Such liquid coatings are known and commercially available and are made of concrete with a polymer additive and a coloring agent added thereto. A typical formulation is 1 part portland cement, 2 parts silica sand, 1 part polymer, 2 parts water and coloring as required. The polymer in this example is available from Concrete Solutions, 6160 Fairmount Avenue, P.O. Box 600526, San Diego, Ca. 92160 although other polymers may be substituted. The coating can be smoothed flush with the tops of the members 12 and 14 using a suitable tool such as a squeegee.

After the coating has been applied, it is allowed to set to produce a water proof surface. The next step is to remove the coating 42 from the tops of the members 12 and 14. In this embodiment the wax is pressure-washed off to reveal the polymer enhanced concrete. This exposes the concave tops 40 of the members 12 and 14 which yields a mortar-like appearance. The members 12 and 14 typically have a suitable contrasting color compared to the coating 60, thus giving a brick-like or stone-like appearance when the process is completed. The mortar-like appearance of the members 12 and 14 is enhanced by their concave tops, an effect not achieved by prior art devices and methods.

ALTERNATIVES AND VARIATIONS

The grid may be made of other materials besides the polymer enhanced concrete. Epoxy has been found suitable, for example G-2 epoxy available from Industrial Formulators of Canada, Ltd., 3824 William Street, Burnaby, Canada V5C 3H9. A fill of glass fiber and silica sand is mixed with the liquid epoxy and poured cold into a mold. Another option is injected molded plastic.

It would be understood by someone skilled in the art that many of the details provided above are by way of example only and are not intended to limit the scope of the invention which is to be interpreted by reference to the following claims.

What is claimed is:

1. A grid for producing a pattern on a surface, the grid comprising:

elongated members connected at intersections and extending about a plurality of open areas to form a mesh-like structure, each said elongated member having a top, a bottom and a thickness extending between the top and the bottom thereof; and connecting members connected to the elongated members at said intersections, each said connecting member extending outwardly from at least one elongated member, each said connecting member having a top, a bottom and a thickness extending between the top and the bottom of said each connecting member which is less than the thickness of said one elongated member, the bottoms of the connecting members and of the elongated members being flush with each other.

2. A grid as claimed in claim 1, wherein the connecting members have inner edges connected to the elongated members and outer edges distal therefrom, the outer edges being convexly curved.

3. A grid as claimed in claim 2, wherein the connecting members are tapered towards the outer edges thereof.

4. A grid as claimed in claim 1, wherein the elongated member have transversely concave tops.

5. A grid as claimed in claim 1, wherein the grid is of concrete.

6. A grid as claimed in claim 1, wherein the grid is of concrete with a polymer additive.

7. A grid as claimed in claim 1, including a plurality of first elongated members and second elongated members, the first elongated members being perpendicular to the second elongated members and being connected thereto at said intersections.

8. A grid as claimed in claim 7, wherein there is a plurality of connecting members at each said intersection, forming a disc-like flange.

9. A grid as claimed in claim 8, wherein there are three said connecting members at each said intersection, one said connecting member being semi-circular and two said connecting members being quarter-circular.

10. A grid as claimed in claim 1, wherein the elongated members are 0.48 to 0.64 cm. thick.

11. A grid as claimed in claim 1, wherein there is a removable layer on the tops of the elongated members.

12. A grid as claimed in claim 11, wherein the removable layer is a wax.

13. A grid as claimed in claim 12, wherein the elongated members and the connecting members have an adhesive on the bottoms thereof.

14. A grid as claimed in claim 1, wherein the connecting members are half the thickness of the elongated members.

15. A method of producing a grid-like pattern on a surface, comprising:

placing on the surface a grid which includes a plurality of elongated members connected together at intersections and extending about a plurality of open areas, said grid having a non-removable body portion having a concave top surface; and a removable layer on said rod surface;

spreading a liquid coating over the surface in the open areas between the elongated members of the grid such that said liquid coating does not substantially cover said grid;

allowing the liquid coating to set; and removing the removable layer from the grid, exposing said concave top surface.

16. A method as claimed in claim 15, wherein the top surface of the elongated members and the liquid coating have contrasting colors.

17. A method as claimed in claim 15, wherein the grid has connecting members extending outwardly from the intersections of the elongated members, said connecting members and elongated members having bottoms which are flush, the connecting members being thinner than the elongated members, the liquid coating being applied over the connecting members.

18. A method as claimed in claim 17, wherein the grid is secured to the surface by fasteners extending through the connecting members.

19. A method as claimed in claim 15, wherein the removable layer is removed by pressure washing after the liquid coating is set.

20. A method as claimed in claim 15, wherein a layer of the liquid coating is applied to the surface before placing the grid and more coating is applied after the grid is placed.

21. A grid for producing a pattern on a surface, said grid comprising;

(a) a plurality of elongated members connected at intersections and extending about a plurality of open areas to form a mesh-like structure, each of said elongated members having a non-removable body portion having a cylindrically concave top surface, a bottom surface and a thickness extending between said top and bottom surfaces; and (b) a removable layer on said concave top surface.

22. The grid as defined in claim 21, wherein said removable layer comprises a removable wax coating.

23. The grid as defined in claim 21, wherein said removable layer comprises peelable tape.

24. The grid as defined in claim 21, wherein said removable layer comprises a plastic coating.

25. The grid as defined in claim 21, wherein said grid further comprises support means extending from said elongated members into said open areas, at least part of said support means having a thickness less than said elongated member thickness.

26. The grid as defined in claim 25, wherein said support means comprises a plurality of flanges connected to said elongated members for fastening said grid to said surface.

27. The grid as defined in claim 26, wherein said flanges are located at said intersections between said elongated members.

28. A grid for producing a pattern on a surface, said grid comprising:

(a) a plurality of elongated members connected at intersections and extending about a plurality of open areas to form a mesh-like structure, each of said elongated members having a top surface, a bottom surface and a thickness extending between said top and bottom surfaces; and (b) support means extending from said elongated members into said open areas, at least part of said support means having a thickness less than said elongated member thickness.

29. The grid as defined in claim 28, further comprising a removable layer on said elongate member top surface.

30. The grid as defined in claim 29, wherein said removable layer comprises a removable wax coating.

31. The grid as defined in claim 29, wherein said removable layer comprises peelable tape.

32. The grid as defined in claim 29, wherein said removable layer comprises a plastic coating.

* * * * *

UNITED STATES PATENT AND TRADEMARK OFFICE

CERTIFICATE OF CORRECTION

PATENT NO. : 5,494,372

DATED : February 27, 1996

INVENTOR(S) : Gerry B. OLIVER; Bruce L. BURTON

It is certified that error appears in the above-indentified patent and that said Letters Patent is hereby corrected as shown below:

In claim 15, column 5, line 42 replace "rod" with --top--.

Signed and Sealed this

Twenty-fifth Day of June, 1996

*Attest:*

Bruce Lehman

BRUCE LEHMAN

*Attesting Officer*

*Commissioner of Patents and Trademarks*